US008388123B2

(12) United States Patent
Smith et al.

(10) Patent No.: US 8,388,123 B2
(45) Date of Patent: Mar. 5, 2013

(54) FLUID CARTRIDGE HAVING FEATURE TO CLEAR BRACKET RISER SURFACES

(75) Inventors: Mark A. Smith, Corvallis, OR (US); David Welter, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 205 days.

(21) Appl. No.: 12/996,606

(22) PCT Filed: Jun. 8, 2008

(86) PCT No.: PCT/US2008/066232

§ 371 (c)(1),
(2), (4) Date: Dec. 6, 2010

(87) PCT Pub. No.: WO2009/151436

PCT Pub. Date: Dec. 17, 2009

(65) Prior Publication Data

US 2011/0090294 A1 Apr. 21, 2011

(51) Int. Cl.
*B41J 2/175* (2006.01)

(52) U.S. Cl. ..... 347/86; 347/19; 347/49; 347/87; 399/111; 439/534

(58) Field of Classification Search ..... None
See application file for complete search history.

(56) References Cited

U.S. PATENT DOCUMENTS

| | | | | |
|---|---|---|---|---|
| 5,036,664 | A * | 8/1991 | Camm | 60/534 |
| 5,680,164 | A * | 10/1997 | Miller et al. | 347/87 |
| 5,825,388 | A * | 10/1998 | Sasaki | 347/86 |
| 6,152,555 | A | 11/2000 | Nozawa et al. | |
| 6,390,601 | B1 | 5/2002 | Morita et al. | |
| 6,533,383 | B1 * | 3/2003 | Saruta et al. | 347/19 |
| 7,725,051 | B2 * | 5/2010 | Lee | 399/111 |
| 2004/0095407 | A1 * | 5/2004 | Saruta | 347/19 |
| 2007/0149044 | A1 * | 6/2007 | Asauchi | 439/534 |

FOREIGN PATENT DOCUMENTS

JP 2004358914 A 12/2004

* cited by examiner

*Primary Examiner* — Matthew Luu
*Assistant Examiner* — John P Zimmermann

(57) ABSTRACT

A fluid cartridge for a fluid-jet precision-dispensing device includes a supply of fluid, a fluid interconnect element, and a feature. The fluid interconnect element establishes a fluid interconnection with a corresponding fluid interconnect element of a bracket upon mating of the fluid cartridge with the bracket. The fluid interconnection permits the fluid from the fluid cartridge to be supplied to the bracket. The feature is adapted to physically clear riser surfaces of the bracket upon mating of the fluid cartridge with the bracket so that the fluid cartridge properly mates with the bracket. The riser surfaces of the bracket at least substantially reduce a likelihood of damage to the corresponding fluid interconnect element by the fluid cartridge during mating of the fluid cartridge with the bracket.

13 Claims, 6 Drawing Sheets

FLUID CARTRIDGE HAVING FEATURE TO CLEAR BRACKET RISER SURFACES

RELATED APPLICATIONS

The present application claims the priority under 35 U.S.C. 119(a)-(d) or (f) and under C.F.R. 1.55(a) of previous International Patent Application No.: PCT/US2008/066232, filed Jun. 8, 2008, entitled "Fluid Cartridge Having Feature to Clear Bracket Riser Surfaces", which application is incorporated herein by reference in its entirety.

BACKGROUND

A common way to form images on media, such as paper, is to use a fluid-ejection device, such as an inkjet-printing device. An inkjet-printing device has a number of inkjet-printing mechanisms, such as inkjet printhead assemblies. Each inkjet printhead assembly has a printhead die having a number of inkjet nozzles that eject ink, such as differently colored ink, in such a way as to form a desired image on the media.

Some types of inkjet-printing devices employ insertable cartridges that include both a supply of ink as well as a printhead die. Depletion of the ink from a cartridge necessitates insertion of a new cartridge having a new printhead die, although the printhead die of the existing cartridge may still be likely in proper functional condition. Therefore, to reduce replacement cartridge expenditures, other types of inkjet-printing devices employ cartridges that contain ink but that do not include a printhead die.

DETAILED DESCRIPTION OF THE DRAWINGS

Figure 1:
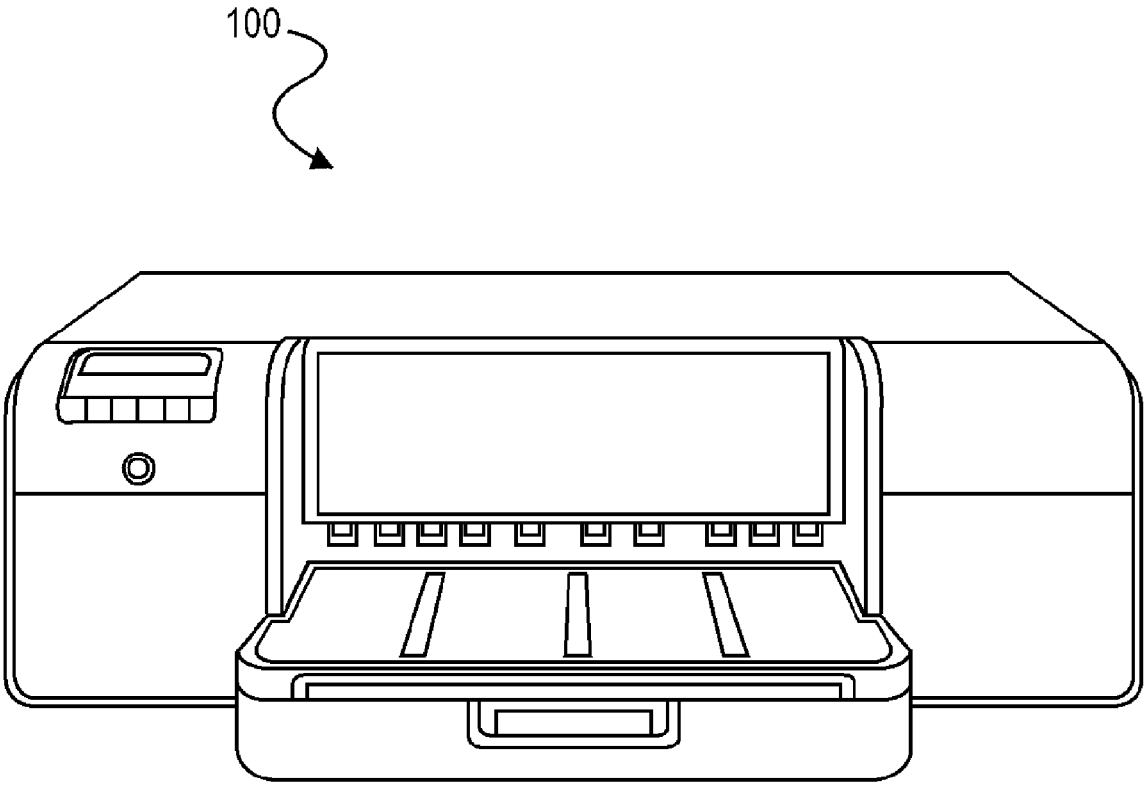
FIG. 1 is a diagram of a representative inkjet-printing device, according to an embodiment of the present disclosure.

FIG. 1 shows a representative inkjet-printing device 100, according to an embodiment of the present disclosure. The inkjet-printing device 100 is a device, such as a printer, that ejects ink onto media, such as paper, to form images, which can include text, on the media. The inkjet-printing device 100 is more generally a fluid-jet precision-dispensing device that precisely dispenses fluid, such as ink, as is described in more detail later in the detailed description.

The inkjet-printing device 100 may eject pigment-based ink, dye-based ink, or another type of ink. Differences between pigment-based inks and dye-based inks can include that the former may be more viscous than the latter, among other differences. In these and other types of ink, the ink may be generally considered as having at least a liquid component, and may also have a solid component in the case of pigment-based inks in particular. The liquid component may be water, alcohol, and/or another type of solvent or other type of liquid, whereas the solid component may be pigment, or another type of solid.

While the detailed description is at least substantially presented herein to inkjet-printing devices that eject ink onto media, those of ordinary skill within the art can appreciate that embodiments of the present disclosure are more generally not so limited. In general, embodiments of the present disclosure pertain to any type of fluid-jet precision-dispensing device that dispenses a substantially liquid fluid. A fluid-jet precision-dispensing device is a drop-on-demand device in which printing, or dispensing, of the substantially liquid fluid in question is achieved by precisely printing or dispensing in accurately specified locations, with or without making a particular image on that which is being printed or dispensed on. As such, a fluid-jet precision-dispensing device is in comparison to a continuous precision-dispensing device, in which a substantially liquid fluid is continuously dispensed therefrom. An example of a continuous precision-dispensing device is a continuous inkjet-printing device, for instance.

The fluid-jet precision-dispensing device precisely prints or dispenses a substantially liquid fluid in that the latter is not substantially or primarily composed of gases such as air. Examples of such substantially liquid fluids include inks in the case of inkjet-printing devices. Other examples of substantially liquid fluids include drugs, cellular products, organisms, fuel, and so on, which are not substantially or primarily composed of gases such as air and other types of gases, as can be appreciated by those of ordinary skill within the art. Therefore, while the following detailed description is described in relation to an inkjet-printing device that ejects ink onto media, those of ordinary skill within the art will appreciate that embodiments of the present disclosure more generally pertain to any type of fluid-jet precision-dispensing device that dispenses a substantially liquid fluid as has been described in this paragraph and the preceding paragraph.

Figure 2:
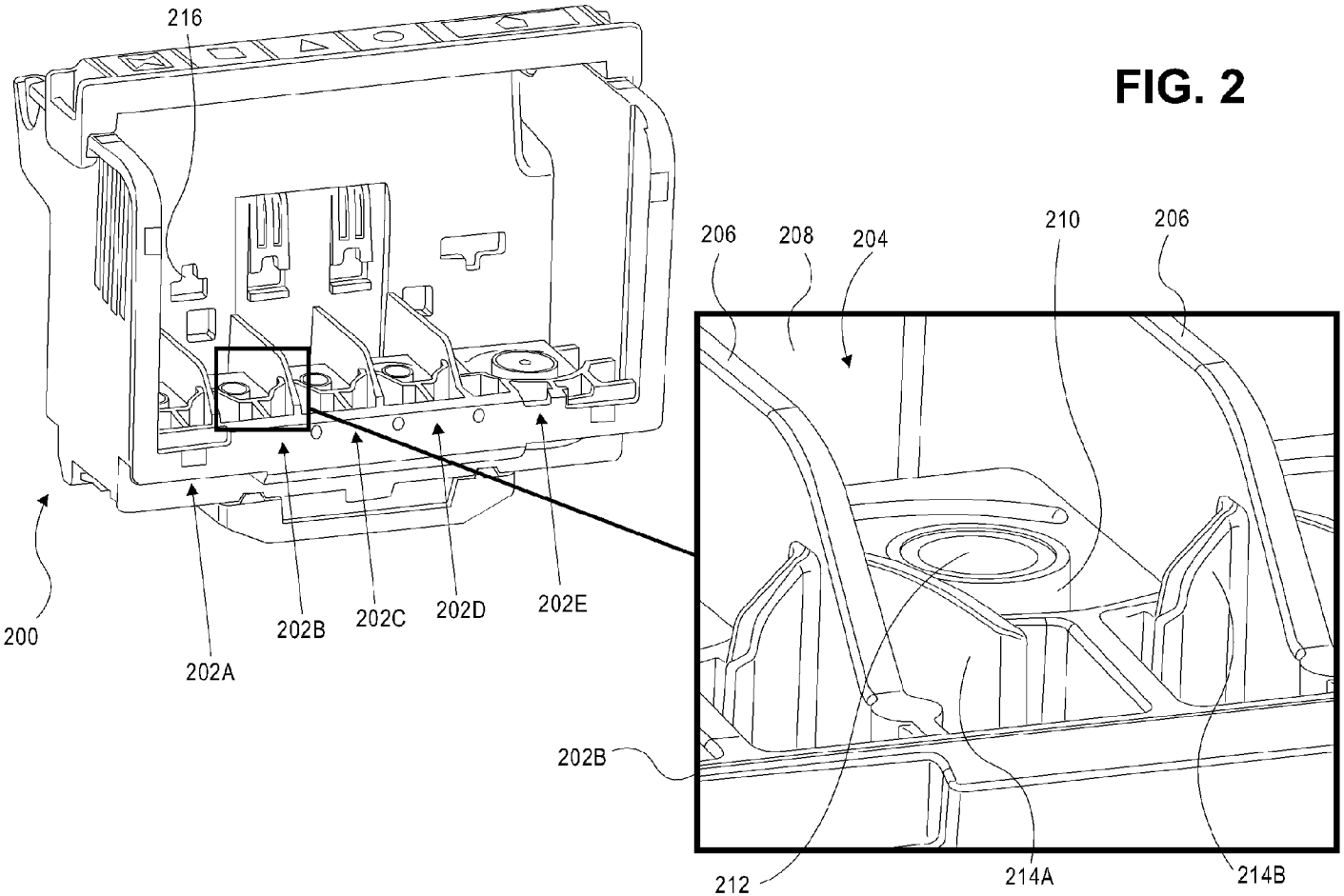
FIG. 2 is a diagram of a bracket for an inkjet-printing device, according to an embodiment of the present disclosure.

FIG. 2 shows a bracket 200 for the inkjet-printing device 100, according to an embodiment of the present disclosure. The terminology bracket 200 is used in a general, generic, and all-encompassing sense, such that the word "bracket" is not used to connote anything about this mechanism other than the functionality and features ascribed to the bracket 200 herein. The bracket 200 may be permanently disposed within the inkjet-printing device 100, such that it is not intended to be and/or cannot be removed from the device 100, or may be removably disposed within the inkjet printing-device 100, such that it is intended to be and can be removed from the device 100.

The bracket 200 has locations 202A, 202B, 202C, 202D, and 202E, collectively referred to as the locations 202. The locations 202 are each receptive to corresponding insertion of an ink cartridge, such that the ink cartridge can be said to mate with the bracket 200 at the location in question. The location 202B is exemplarily described as representative of all the locations 202 in this respect. Furthermore, there is a hole 216 corresponding to the location 202B located at a back wall of the bracket 200, where each of the locations 202 includes a corresponding hole.

The bracket 200 at the location 202B includes a well 204 defined by sidewalls 206 and back wall 208. A protrusion 210—in the form of a tower in FIG. 2—extends from the bottom of the well. A filter screen 212 is located at the protrusion 210. The filter screen 212 is more generally a fluid interconnect element. The filter screen 212 can be a mesh of stainless steel wires.

The bracket 200 at the location 202B also includes two riser surfaces 214A and 214B, collectively referred to as the riser surfaces 214. While there are two riser surfaces 214 depicted in FIG. 2, in other embodiments there may be more or less than two of the riser surfaces 214. The riser surfaces 214 extend above the protrusion 210 and thus above the filter screen 212. The riser surfaces 214 are located in front of the protrusion 210. An ink cartridge is inserted into the inkjet-printing device 100 to mate with the bracket 200 at the location 202B.

The riser surfaces 214 are substantially located to either side of the protrusion 210 in the embodiment of FIG. 2. Furthermore, in the embodiment of FIG. 2, the riser surfaces 214 are ramp surfaces. In this embodiment, the riser surfaces have a first end located farther away from the protrusion 210 and thus from the filter screen 212 that is lower than a second end locates towards and closer to the protrusion 210 and thus to the filter screen 212. That is, it can be said that the riser surfaces 214 in this embodiment ramp up as the protrusion 210 and the filter screen 212 therein are approached.

Figure 3:
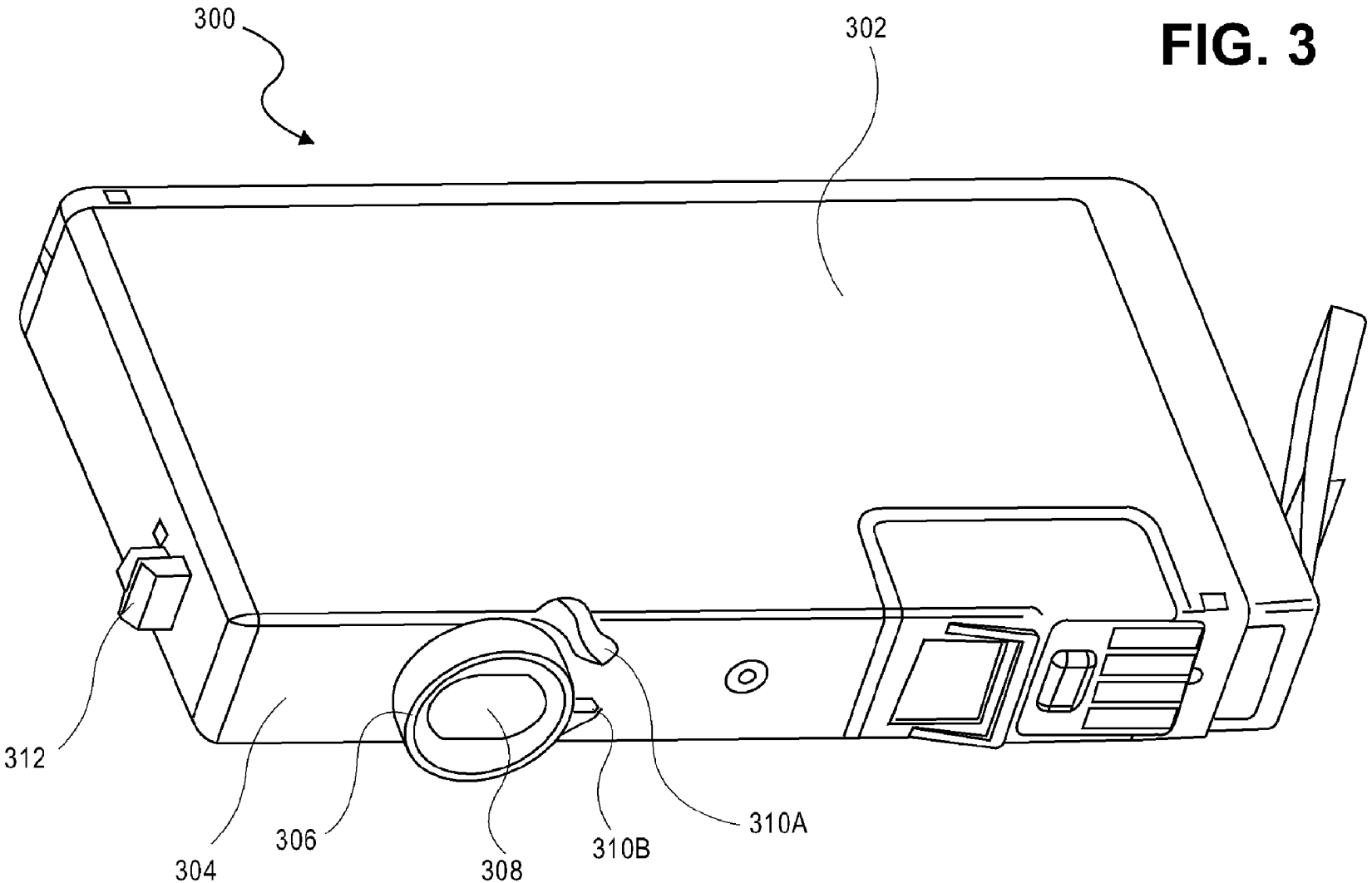
FIG. 3 is a diagram of an ink cartridge for an inkjet-printing device, according to an embodiment of the present disclosure.

FIG. 3 shows an ink cartridge 300 for the inkjet-printing device 100, according to an embodiment of the present disclosure. The ink cartridge 300 is more generally a fluid cartridge. The ink cartridge 300 contains a supply of ink, and more generally a supply of fluid. The ink cartridge 300 mates with the bracket 200 at one of the locations 202 upon insertion of the ink cartridge 300 into the inkjet-printing device 100.

The ink cartridge 300 has a housing 302 that has an external surface 304. A protrusion 306 extends from the surface 304 of the housing 302. The protrusion 306 may also be referred to as a snout. Foam 308 is located at the protrusion 306. The foam 308 is more generally a fluid interconnect element.

The ink cartridge 300 includes indentations 310A and 310B, collectively referred to as the indentations 310, within the external surface 304 of the housing 302. The indentations 310 correspond to the riser surfaces 214 of the bracket 200. While there are two indentations 310 depicted in FIG. 3, in other embodiments there may be more or less than two of the indentations 310. The indentations 310 more generally constitute a feature, and more generally the feature may be something other than the indentations 310.

The indentations 310 physically clear the riser surfaces 214 of the bracket 200 when the ink cartridge 300 is inserted into the inkjet-printing device 100 for mating of the ink cartridge 300 with the bracket 200, so that the ink cartridge 300 properly mates with the bracket 200. That is, were the indentations 310 not present, the ink cartridge 300 would not properly seat within the bracket 200 due to the riser surfaces 214. Other types of features that can provide this type of functionality include reliefs of any types, such as holes, counter bores, as well as a general raising of the external surface 304 in relation to the protrusion 306 such that the protrusion 306 in effect becomes taller.

The ink cartridge 300 includes a hook 312 extending from the housing 302. The hook 312 corresponds to the hole 216 of the bracket 200. Thus, upon mating of the ink cartridge 300 to the bracket 200, the hook 312 is inserted into the hole 216.

Figure 4:
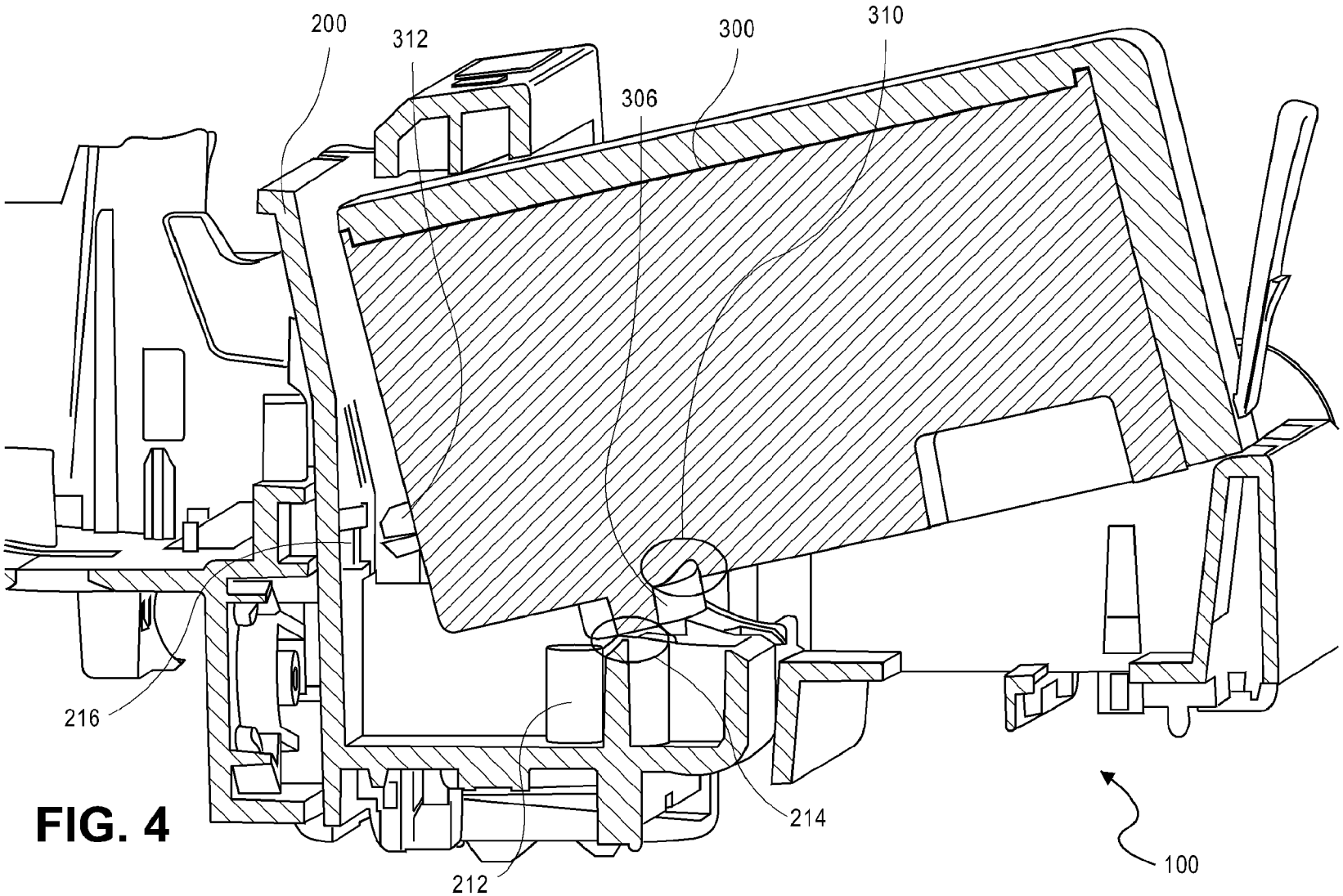
FIG. 4 is a cross-sectional diagram depicting an ink cartridge in the process of mating with a bracket, according to an embodiment of the present disclosure.

FIG. 4 shows a cross-section of a portion of the inkjet-printing device 100, specifically depicting the ink cartridge 300 mating with the bracket 200 upon the ink cartridge 300 being inserted into the device 100, according to an embodiment of the present disclosure. The mating process involves two motions. First, the ink cartridge 300 is moved laterally towards the bracket 200 so that the hook 312 of the cartridge 300 is desirably at least partially inserted into the hole 216 of the bracket 200. Second, the ink cartridge 300 is moved downwards towards the bracket 200 so that the protrusion 306 of the cartridge 300 is located over the protrusion 212 of the bracket 200. The latter movement also results in the indentations 310 of the ink cartridge 300 physically clearing and fitting against the riser surfaces 214 of the bracket 200.

It is noted that the riser surfaces 214 protect the filter screen 308 (not particularly called out in FIG. 4) located within the protrusion 308 during the mating process depicted in FIG. 4. In particular, were the riser surfaces 214 not present, there is a high likelihood that the protrusion 306 may contact the filter screen 308 and potentially permanently damage the screen 308 during the mating process. The presence of the riser surfaces 214 at least substantially reduce the likelihood of damage to the filter screen 308 by the ink cartridge 300, by at least substantially preventing the protrusion 306 in particular from contacting the filter screen 308 during the mating process.

That is, it has been found that users generally attempt to insert the ink cartridge 300 into the bracket 200 using a diagonal motion that results in the protrusion 306 of the cartridge 300 contacting and potentially damaging the filter screen 308 during the mating process. The presence of the riser surfaces 214 prevents the protrusion 306 of the ink cartridge 300 from contacting and potentially damaging the filter screen 308. In particular, the presence of the riser surfaces 214 effectively can force the users to insert the ink cartridge 300 into the bracket 200 using a horizontal or lateral motion first, followed by a vertical motion second.

Figure 5:
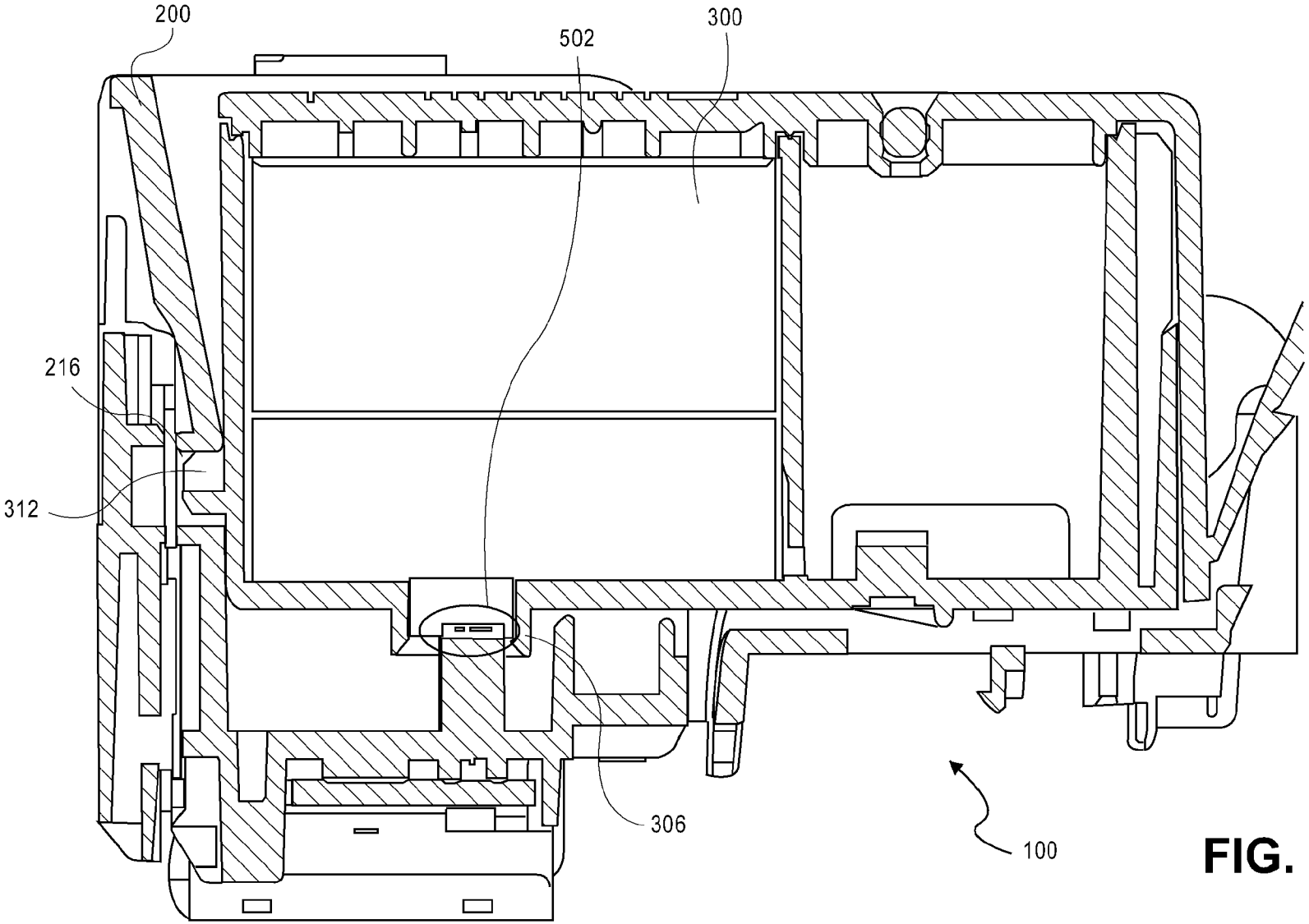
FIG. 5 is a cross-sectional diagram depicting an ink cartridge having been mated with a bracket, according to an embodiment of the present disclosure.

FIG. 5 shows a cross-section of a portion of the inkjet-printing device 100, specifically depicting the ink cartridge 300 having mated with the bracket 200 upon the ink cartridge 300 having been inserted into the device 100, according to an embodiment of the present disclosure. It is noted that the cross-section of FIG. 5 is a different cross-section than the cross-section of FIG. 4, such that not all of the aspects depicted in FIG. 4 are depicted in FIG. 5, and vice-versa. For instance, the protrusion 306 of the ink cartridge 300 is visible in FIG. 5, but not the protrusion 212 of the bracket 200. In FIG. 5, the hook 312 of the ink cartridge 300 has been inserted into the corresponding hole 216 of the bracket 200.

A fluidic interconnection 502 has been established in FIG. 5 upon the ink cartridge 300 having mated with the bracket 200. The fluid interconnection 502 is between the foam 308 of the ink cartridge 300 and the filter screen 212 of the bracket 200. However, neither the foam 308 nor the filter screen 212 is particularly called out in FIG. 5. The fluid interconnection 502 permits ink from the ink cartridge 300 to be supplied to the bracket 200. The fluid interconnection 502 particularly results from the filter screen 212 of the bracket 200 being pressed into the foam 308 of the ink cartridge 300 upon the cartridge 300 mating with the bracket 200.

The filter screen 212 has a bubble, or critical, pressure that is sufficient to permit ink to be supplied from the ink cartridge 300 without pulling any air or other gas. If the filter screen 212 were to be damaged, then, the likelihood that air or other gas may undesirably pulled into the bracket 200 at the fluidic interconnection 502 greatly increases. Furthermore, if the filter screen 212 were damaged, ink may not be able to be supplied from the ink cartridge 300 at the desired flow rate. This is why the riser surfaces 214 of the bracket 200 protecting the filter screen 212 from damage during the mating process of the ink cartridge 300 with the bracket 200 can be important.

Figure 6:
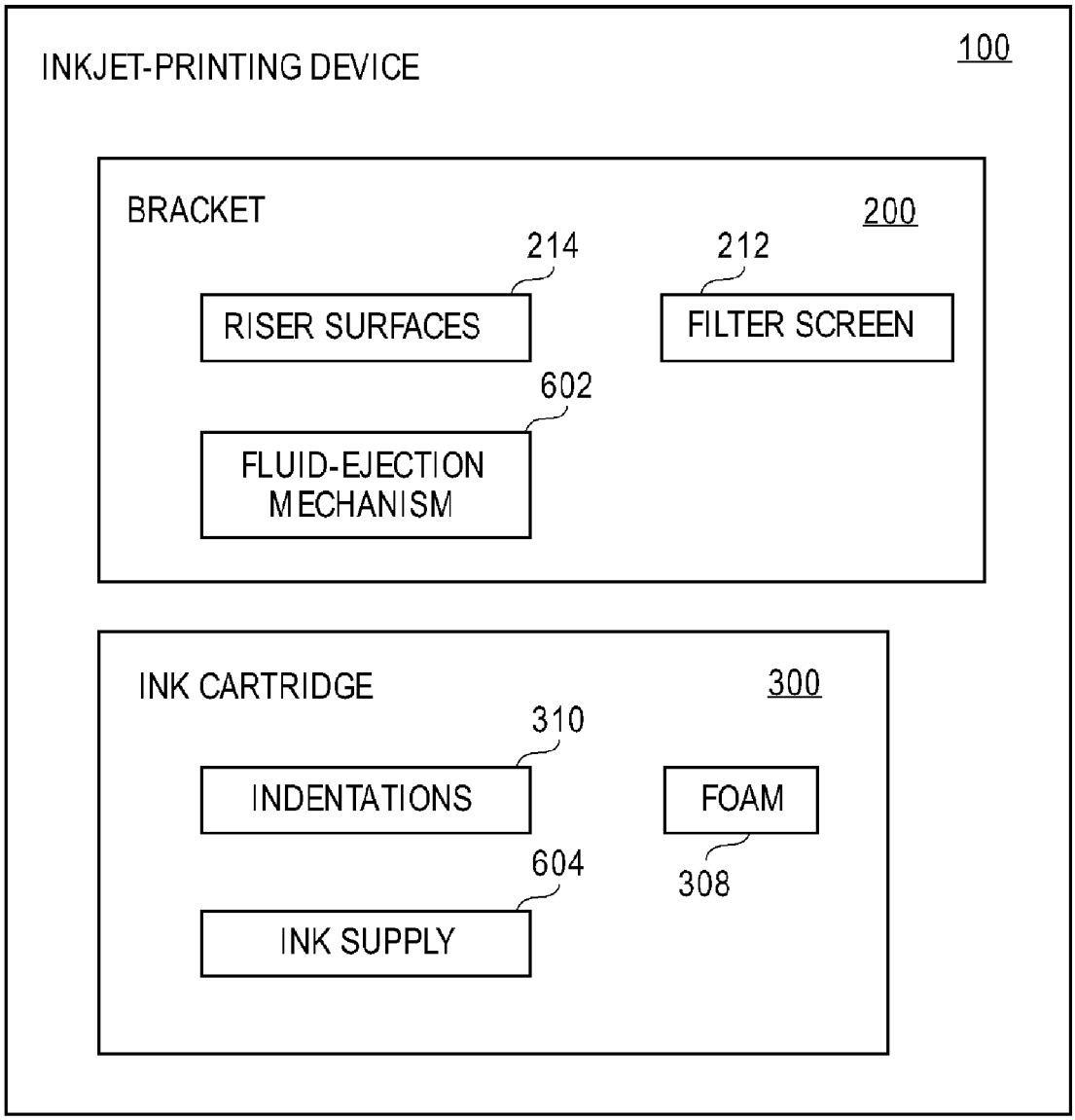
FIG. 6 is a block diagram of a rudimentary inkjet-printing device, according to an embodiment of the present disclosure.

In conclusion, FIG. 6 is a block diagram of the inkjet-printing device 100, according to an embodiment of the present disclosure. The inkjet-printing device 100 includes at least the bracket 200 and the ink cartridge 300 that have been described. Those of ordinary skill within the art can appreciate that the inkjet-printing device 100 typically includes other components in addition to the bracket 200 and the ink cartridge 300.

The bracket 200 is specifically depicted in FIG. 6 as including the riser surfaces 214 that have been described, the filter screen 212 that has been described, and a fluid-ejection mechanism 602. The filter screen 212 is more generally a fluid interconnect element, and alternatively can be a needle, a septum, or another type of fluid interconnect element. The fluid-ejection mechanism 602, when present, can include one or more inkjet printheads or inkjet printhead assemblies that include one or more printhead dies that contain the inkjet nozzles from which ink is ejected. More generally, the fluid-ejection mechanism 602 is a fluid-jet precision-dispensing mechanism to precisely dispense fluid, such as ink, at accurately specified locations, as has been described.

The ink cartridge 300 is specifically depicted in FIG. 6 as including the indentations 310 that have been described, the foam 308 that has been described, and an ink supply 604. The indentations 310 are more generally a feature that physically clears the riser surfaces 214 of the bracket 200 upon mating of the ink cartridge 300 with the bracket 200 so that the cartridge 300 properly mates with the bracket 200. The foam 308 is more generally a fluid interconnect element, and alternatively can be a needle, a septum, or another type of fluid interconnect element. The ink supply 604 is more generally a supply of fluid that is at least substantially liquid.

We claim:

1. A fluid cartridge for a fluid-jet precision-dispensing device, comprising:

a supply of fluid;

a fluid interconnect element to establish a fluid interconnection with a corresponding fluid interconnect element of a bracket upon mating of the fluid cartridge with the bracket, the fluid interconnection permitting the fluid from the fluid cartridge to be supplied to the bracket; and, a feature comprising a number of indentations defined in the external surface of the cartridge to physically clear riser surfaces of the bracket and mate with the riser surfaces upon mating of the fluid cartridge with the bracket so that the fluid cartridge properly mates with the bracket, wherein the riser surfaces of the bracket at least substantially reduce a likelihood of damage to the corresponding fluid interconnect element by the fluid cartridge during mating of the fluid cartridge with the bracket.

2. The fluid cartridge of claim 1, further comprising:

a protrusion extending from the external surface of the fluid cartridge, the fluid interconnect element located at the protrusion.

3. The fluid cartridge of claim 1, wherein the fluid interconnect element comprises foam and the corresponding fluid interconnect element comprises a filter screen, such that the fluid interconnection results from the filter screen being pressed into the foam.

4. The fluid cartridge of claim 1, wherein the bracket comprises:

a well; and, a protrusion extending from a bottom of the well, the corresponding fluid interconnect element of the bracket located in the protrusion, wherein the riser surfaces extend above the protrusion at least partially in front of the protrusion from where the fluid cartridge is inserted into the fluid-jet precision-dispensing device to mate with the bracket.

5. The fluid cartridge of claim 4, wherein the riser surfaces are located to either side of the protrusion, in front of the protrusion.

6. The fluid cartridge of claim 1, wherein the riser surfaces are ramp surfaces having a first end located away from the corresponding fluid interconnect element and that is lower than a second end located towards the corresponding fluid interconnect element.

7. The fluid cartridge of claim 1, wherein the bracket is removably disposed within the fluid-jet precision-dispensing device.

8. The fluid cartridge of claim 1, wherein the bracket is permanently disposed within the fluid-jet precision-dispensing device.

9. The fluid cartridge of claim 1, wherein the fluid-jet precision-dispensing device is an inkjet-printing device.

10. A fluid cartridge for a fluid-jet precision-dispensing device, comprising:

a supply of fluid;

a fluid interconnect element to establish a fluid interconnection with a corresponding fluid interconnect element of a bracket upon mating of the fluid cartridge with the bracket, the fluid interconnection permitting the fluid from the fluid cartridge to be supplied to the bracket; and, means for physically clearing riser surfaces of the bracket upon mating of the fluid cartridge with the bracket so that the fluid cartridge properly mates with the bracket; the means for physically clearing the riser surfaces comprises a number of indentations defined within the external surface of the fluid cartridge, the indentations corresponding to the riser surfaces of the bracket such that the riser surfaces and indentations mate when the fluid cartridge is mated with the bracket, wherein the riser surfaces of the bracket at least substantially reduce a likelihood of damage to the corresponding fluid interconnect element by the fluid cartridge during mating of the fluid cartridge with the bracket.

11. The fluid cartridge of claim 10, further comprising:

a protrusion extending from the external surface of the fluid cartridge, the fluid interconnect element located at the protrusion.

12. The fluid cartridge of claim 10, wherein the fluid interconnect element comprises foam and the corresponding fluid interconnect element comprises a filter screen, such that the fluid interconnection results from the filter screen being pressed into the foam.

13. A fluid cartridge for an ink jet printing device, comprising:

a supply of ink;

a fluid interconnect element to establish a fluid interconnection with a corresponding fluid interconnect element of a bracket upon mating of the fluid cartridge with the bracket, the fluid interconnection permitting the fluid from the fluid cartridge to be supplied to the bracket; and, a number of indentations defined in the external surface of the cartridge adapted to physically clear riser surfaces of the bracket and mate with the riser surfaces upon mating of the fluid cartridge with the bracket so that the fluid cartridge properly mates with the bracket, in which the riser surfaces of the bracket at least substantially reduce a likelihood of damage to the corresponding fluid interconnect element by the fluid cartridge during mating of the fluid cartridge with the bracket; and in which the riser surfaces are ramp surfaces having a first end located away from the corresponding fluid interconnect element that is lower than a second end located towards the corresponding fluid interconnect element; the ramp surfaces reducing a likelihood of damage to the corresponding fluid interconnect element by the fluid cartridge during mating.

* * * * *